US007706717B2

(12) United States Patent
Jones

(10) Patent No.: US 7,706,717 B2
(45) Date of Patent: Apr. 27, 2010

(54) METHODS FOR IMAGING CARTRIDGE CONVERSION

(75) Inventor: James H. Jones, Fayetteville, NC (US)

(73) Assignee: Static Control Components, Inc., Sanford, NC (US)

( * ) Notice: Subject to any disclaimer, the term of this patent is extended or adjusted under 35 U.S.C. 154(b) by 145 days.

(21) Appl. No.: 11/983,064

(22) Filed: Nov. 7, 2007

(65) Prior Publication Data

US 2009/0116868 A1 May 7, 2009

(51) Int. Cl.
*G03G 15/00* (2006.01)
*G03G 21/00* (2006.01)

(52) U.S. Cl. ..... 399/109; 399/350

(58) Field of Classification Search ..... 399/109, 399/350, 110; 15/256.5, 256.51
See application file for complete search history.

(56) References Cited

U.S. PATENT DOCUMENTS

| | | | | |
|---|---|---|---|---|
| 5,528,341 | A * | 6/1996 | Shishido et al. | 399/109 |
| 6,405,015 | B1 | 6/2002 | Suzuki | |
| 2004/0265024 | A1 * | 12/2004 | Naruse et al. | 399/350 |
| 2005/0254868 | A1 * | 11/2005 | Naruse et al. | 399/350 |
| 2009/0087217 | A1 * | 4/2009 | Norris et al. | 399/109 |

* cited by examiner

*Primary Examiner*—Sophia S Chen

(57) ABSTRACT

Techniques are provided for modifying an image processing cartridge. In one aspect, a method of modifying one such imaging process cartridge is disclosed. The method provides the imaging process cartridge, the imaging process cartridge has a waste bin assembly, and the waste bin assembly further has an organic photo conductor (OPC) drum which is coupled with a first wiper blade. The first wiper blade exerts a first abutment pressure when the first wiper blade is coupled to the OPC drum. The method removes the first wiper blade and installs a second wiper blade, wherein the second wiper blade exerts a second abutment pressure when coupled to the OPC drum.

3 Claims, 6 Drawing Sheets

METHODS FOR IMAGING CARTRIDGE CONVERSION

FIELD OF INVENTION

The present invention relates to remanufacturing and modifying imaging process cartridges, such as printer toner cartridges, and more particularly to techniques for modifying an imaging process cartridge to increase the effective cleaning characteristic of an imaging process cartridge.

BACKGROUND

In the printing process, more specifically the electro-photographic process, an image is typically transferred from a computer or other source to a print media. As part of the printing process, the image is created by the image source and may be etched electronically using a laser onto an organic photo conductor (OPC) drum. Etching the OPC drum may create areas on the OPC drum that are electrostatically discharged. As the OPC drum rotates, toner having oppositely charged particles may be transferred from a developer or presentation roller to the OPC drum. The toner may then be transferred to the print media and fused into the media.

As part of the printing process, excess or undeveloped toner may remain on the OPC drum. The toner can adhere to the OPC drum mechanically or through static electricity. Typically an elastic blade, commonly referred to in the industry as a cleaning blade or a wiper blade, is positioned against the OPC drum. The wiper blade is positioned to distribute pressure equally along the edge of the blade as the blade is positioned against the OPC drum. As the OPC drum rotates, the edge of the wiper blade scrapes off any excess toner that may be remaining on the OPC drum after the drum has transferred toner to the print media. The excess toner that is scrapped off the OPC drum is deposited in a waste bin section of the toner cartridge.

Removing the excessive or undeveloped toner may be complicated due to the surface roughness characteristics of the OPC drum. Surface imperfections on the OPC drum may allow the toner to become entrapped in areas where the wiper blade may not be able to adequately reach. This allows the waste or underdeveloped toner to pass underneath the wiper blade and become attached to the primary charge roller (PCR), resulting in various print defects. If the wiper blade does not effectively remove the excess toner, additive buildup of excess toner on the PCR may occur. The additive buildup insulates the PCR, reducing the charging capacity of the OPC drum. The reduced charge appears as a discharged area on the OPC drum resulting in toner being deposited into undesired areas of the OPC drum. This printing defect most often appears as vertical streaks in the direction the page travels during the printing process.

An emerging industry has developed that deals with the recycling of printer cartridges. Typically, the cartridge is recycled by a cartridge remanufacturer, who receives spent printer cartridges and refurbishes them. The refurbishment process entails replacing the worn or nonfunctioning parts, refilling the cartridge with either toner or ink, and distributing the refurbished cartridges into the marketplace. In some instances, different or newer toner may be installed in the original equipment manufacturer's (OEM) cartridges during the refurbishment process. Using different toner within an OEM cartridge may create printing difficulties due to possible incompatibility issues with the OEM cartridge.

As newer types of toners are developed, the characteristics of the toner may be different when compared to OEM toners.

Newer toners may have different electrostatic charge characteristics as well as dimensional differences. For example, newer toner may be smaller or have different outline characteristics when compared to the OEM toner. An OEM imaging process cartridge with newer toner installed may not print properly due to problems arising from removing excess or waste toner from the OPC drum. In this instance, the OEM wiper blade may apply too little abutment pressure against the OPC drum to effectively remove the new toner.

SUMMARY

The present invention recognizes the need to increase the abutment pressure created by the wiper blade against the OPC drum. By increasing the abutment pressure of the wiper blade against the OPC drum surface, the cleaning effectiveness can be increased. This increased pressure may allow the wiper blade to conform to the surface OPC reaching the entrapped areas as previously described. Additionally, the increased pressure will also build a continuous blocking member so that toner can be moved away from the OPC overcoming the electrostatic effect of any remaining toner.

A method of modifying an imaging process cartridge is disclosed. The method provides the imaging process cartridge, the imaging process cartridge has a waste bin assembly, the waste bin assembly further has an organic photo conductor (OPC) drum which is coupled with a first wiper blade. The first wiper blade exerts a first abutment pressure when the first wiper blade is coupled to the OPC drum. The method removes the first wiper blade and installs a second wiper blade, wherein the second wiper blade exerts a second abutment pressure when coupled to the OPC drum.

Another method of modifying an imaging process cartridge is disclosed. The method provides the imaging process cartridge, the imaging process cartridge having a waste bin assembly, the waste bin assembly further having an organic photo conductor (OPC) drum which is coupled with a wiper blade. The wiper blade exerts a first abutment pressure when the wiper blade is coupled to the OPC drum. The method further removes the wiper blade and then modifies the wiper blade. The method reattaches the modified wiper blade, wherein the modified wiper blade exerts a second abutment pressure when coupled to the OPC drum.

A modified imaging process cartridge is disclosed. The modified imaging process cartridge has a waste bin assembly; the waste bin assembly further has a replacement wiper blade coupled to an organic photo conductor (OPC) drum. The replacement wiper blade exerts a first abutment pressure against the OPC drum when the replacement wiper blade is in contact with the OPC drum, wherein the first abutment pressure is greater than an original abutment pressure caused by an original wiper blade when the original wiper blade was coupled to the OPC drum.

A more complete understanding of the present invention, as well as further features and advantages of the invention, will be apparent from the following detailed description and the accompanying drawings.

DETAILED DESCRIPTION

The following detailed description of preferred embodiments refers to the accompanying drawings, which illustrate specific embodiments of the invention. In the discussion that follows, specific systems and techniques for repairing, manufacturing or remanufacturing an imaging cartridge, such as a toner cartridge are used as examples. Other embodiments having different structures and operations for the repair, remanufacture and operation of other types of replaceable imaging components and for various types of imaging devices, such as laser printers, inkjet printers, copiers, facsimile machines and the like, do not depart from the scope of the present invention.

In the imaging industry, there is a growing market for the remanufacture and refurbishing of various types of replaceable imaging cartridges such as toner cartridges, drum cartridges, inkjet cartridges, and the like. These imaging cartridges are used in imaging devices such as laser printers, xerographic copiers, inkjet printers, facsimile machines and the like, for example. Imaging cartridges, once spent, are unusable for their originally intended purpose. Without a refurbishing process these cartridges would simply be discarded, even though the cartridge itself may still have potential life. As a result, techniques have been developed specifically to address this issue.

In the refurbishment process, the spent imaging process cartridges are collected and serviced by the toner cartridge remanufacturers. The first step in the refurbishment process is the disassembling of the spent cartridges. Next, the internal components may be separated. Non-functioning components are replaced, and the remaining components, as well as the body of the imaging process cartridge undergo a cleaning process. In the final step the device is reassembled and new toner is added to the toner cartridge. The refurbished device is then packaged and distributed to the consumer. Part of the refurbishment process may include making physical alterations to or installing new components that may alter the operating conditions exhibited on the OEM toner cartridge.

Figure 1:
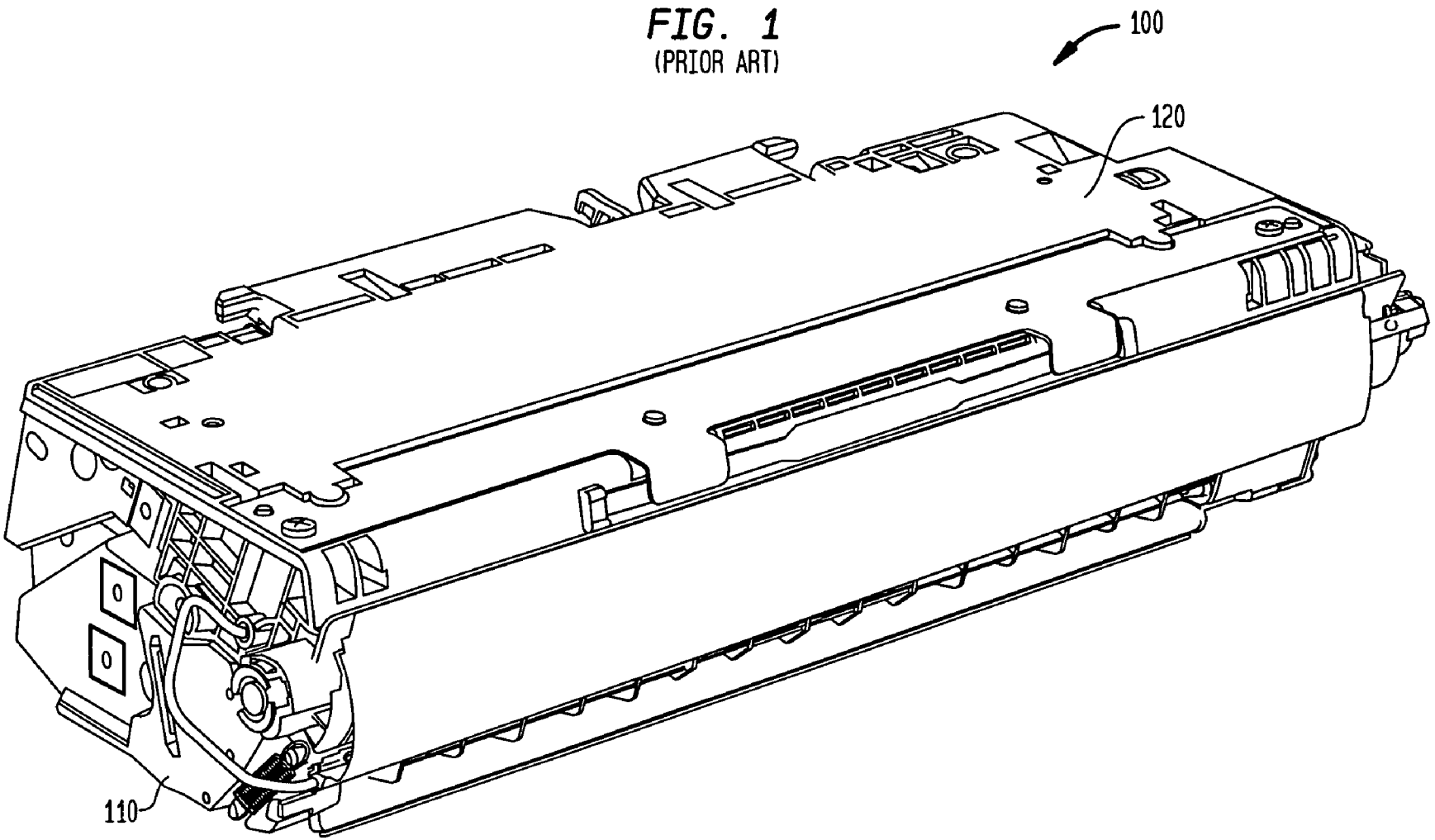
FIG. 1 (PRIOR ART)
FIG. 1 shows a front perspective view of a fully assembled prior art HP3700/3500 toner cartridge.

One such cartridge that may be recycled is displayed in FIG. 1. FIG. 1 displays a perspective view of a fully assembled OEM HP 3700 toner cartridge 100. The toner cartridge 100 has a toner hopper 110 for storing toner and a waste bin assembly 120 for collecting waste toner. During the printing process, toner is transferred to the various operating components and eventually on to print media. After a certain number of prints, the amount of usable toner in the toner hopper 110 may become depleted. When the amount of usable toner reaches a predetermined threshold, the printer may disable the printer cartridge. The spent toner cartridge may be discarded or may be remanufactured.

Those skilled in the art appreciate that during the laser printing process, the printer applies a uniform charge on the organic photo conductor (OPC) drum. The printer then uses a laser to electro-statically discharge an image on the OPC drum. The OPC drum then collects toner from the toner hopper 110 which is in turn applied to the print media. After the toner is transferred to the printing media, the toner is fused onto the print media by a fuser assembly (not shown). During the printing process and more particularly the image/toner transfer process some excess toner may remain on the OPC drum. The remaining toner may also be referred to as waste toner and must be removed from the OPC drum in order to allow the OPC drum to receive a uniform charge for the next printing cycle.

Figure 2:
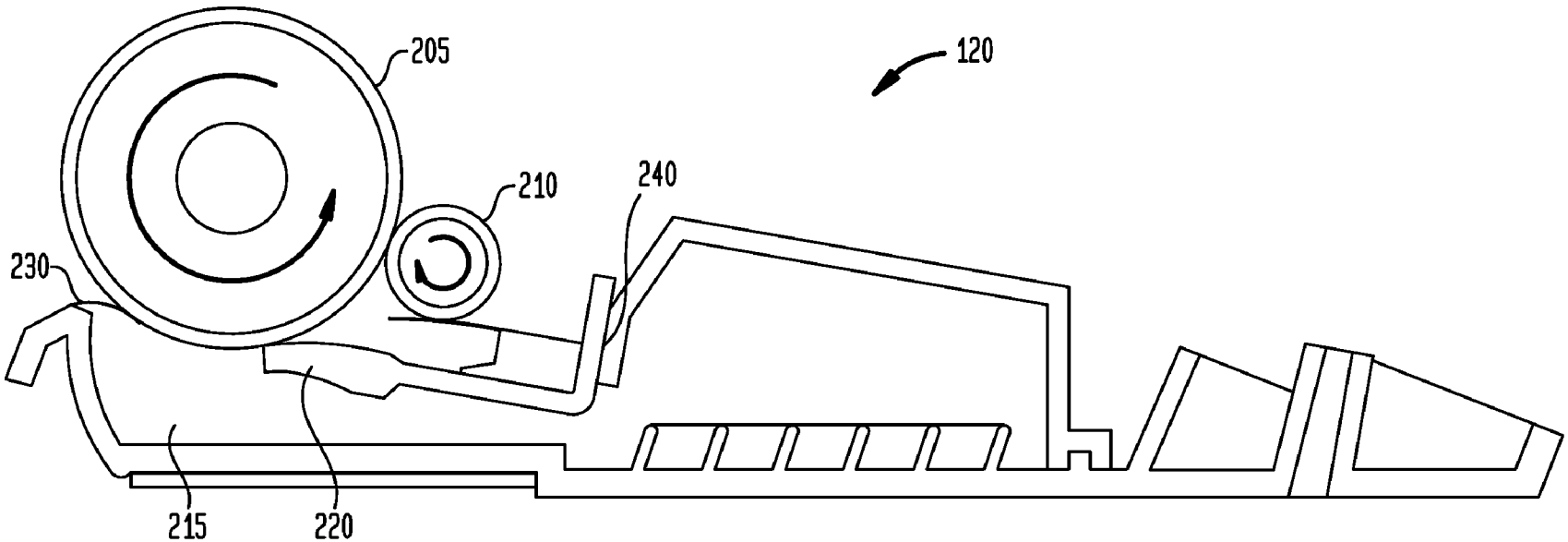
FIG. 2 (PRIOR ART)
FIG. 2 shows a cross sectional view of a waste bin assembly of the toner cartridge of FIG. 1.

The removal of waste toner may be better understood by referring to the cross sectional view of the waste bin assembly 120 as displayed in FIG. 2. Within the waste bin assembly 120 is an OPC drum 205 which is in contact with a primary charge roller (PCR) 210. As shown by the directional arrows, the OPC drum 205 spins in a counter-clockwise direction while the PCR 210 rotates in a clockwise direction. The PCR 210 applies a uniform static charge to the surface of the OPC drum 205, clearing any residual charge from the previous printing. The uniform charge may then be discharged according to the image being printed by the laser within the printer. Mounted below the OPC drum 205 is an OEM wiper blade 220. The OEM wiper blade 220 extends laterally across and touches the cylindrical surface of the OPC drum 205. When the OEM wiper blade 220 is installed on the waste bin assembly 120, a compression foam 240 may be inserted between the wiper blade and the waste bin assembly 120.

Excess or underdeveloped toner may remain on the OPC drum 205 after the image has transferred to the media. As the OPC drum rotates in a counter-clockwise direction, the abutment pressure exerted against the OPC drum 205 by the OEM wiper blade 220 causes any excess or underdeveloped toner to fall off and be deposited in the waste collection area 215. A waste toner seal 230 keeps the waste toner from leaving the waste collection area 215 near the OPC drum 205. Typically, the OEM designs the OEM wiper blade 220 to exert a particular abutment pressure against the OPC drum 205. As is explained in greater detail in subsequent sections, embodiments of the present invention may be used in order to change the abutment pressure.

As discussed previously, during the refurbishment process, the toner cartridge 100 may be disassembled and any worn or broken components may be replaced. New toner may be then added to the toner cartridge 100 when the toner cartridge is reassembled. When replacing the worn or broken components, the remanufacturer may replace the OEM parts with parts that may have slightly different operating characteristics. Alternatively, the remanufacturer may modify the OEM components to create a component with slightly different operating characteristics. In accordance with one embodiment of the present invention, the OEM wiper blade 220 may be altered or replaced with a replacement wiper blade which may exert a different pressure (when compared to the OEM wiper blade 220) against the OPC drum when the replacement wiper blade is installed in the refurbished toner cartridge.

A replacement wiper blade may be developed to provide a different abutment pressure in order to provide better cleaning results. As new toners are developed, the newer toners may exhibit slightly different characteristics than that of the OEM toners. For example, the toner may have a slightly different shape than the OEM toner. Alternatively, the newer toners may have slightly stronger electrostatic charge characteristics than the OEM toner. If the OEM wiper blade was reused during the refurbishment process with out any modifications, the new toner may not be cleaned off the OPC drum 205 properly. Additionally, the surface of the OPC drum 205 may vary between different suppliers. If a replacement OPC drum 205 has more surface imperfections and was used during the refurbishment process, an OEM wiper blade 220 may not exert enough abutment pressure necessary to clean the surface of the OPC drum 205.

Figure 3:
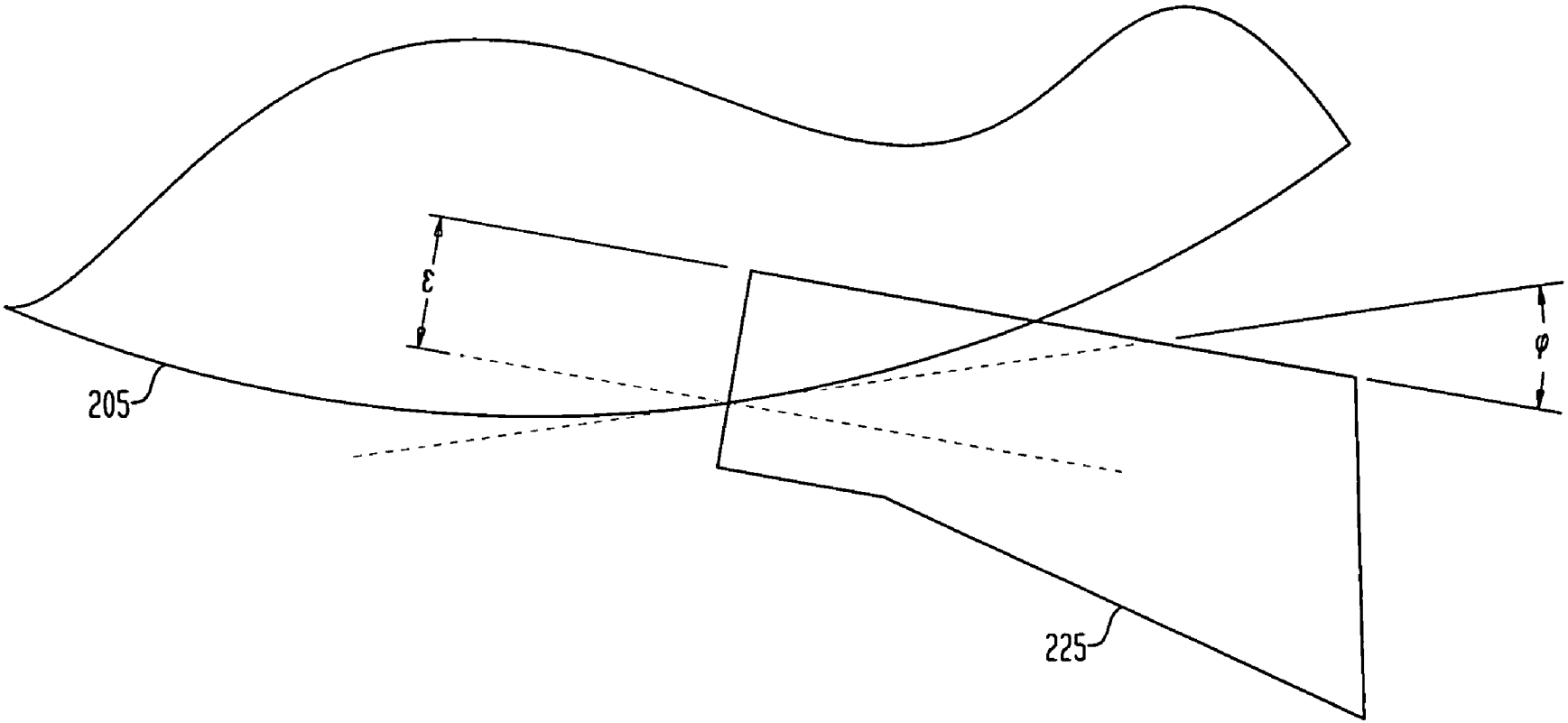
FIG. 3 shows a closer view of the wiper blade as it makes contact with the OPC drum.

When determining the proper amount of abutment pressure to apply with the flexible tip 225, several factors should be taken into consideration. FIG. 3 displays a more detailed view of the flexible tip 225 of the OEM wiper blade 220 as it is pressed against the surface of the OPC drum 205. Those of sufficient skill in the art appreciate that the amount of material that would protrude against the surface of the OPC drum 205 may also be referred to as the "inroad amount" $\epsilon$. The inroad amount $\epsilon$ may also be considered a virtual amount of the edge of the flexible tip 225 inroading into the OPC drum 205 if the flexible tip 225 does not deform. The preset angle $\Phi$ is an angle made at a tangent point where the edge of the flexible tip 225 would touch the OPC drum 205 if the flexible tip 225 did not deform. On the OEM toner cartridge 100, the OEM wiper blade 220 has a preset angle $\Phi$ of about 27° and an inroad amount of about 0.0373" (0.9 mm). The resulting abutment pressure exerted by the OEM wiper blade 220 on the OPC drum 205 is about 94 g/cm.

Another characteristic to take into consideration when determining the proper abutment pressure is the hardness of the flexible tip 225. When measuring the hardness of the flexible tip 225, the measurement is most commonly measured by the Shore® (Durometer) test or Rockwell hardness test. Both methods measure the resistance of plastics toward indentation and provide an empirical hardness value. Specifically for measuring the hardness of the flexible tip 225, the Shore A scale, is the preferred method. Typically the Shore A scale is used for 'softer' rubbers. Typically in the OEM wiper blade 220, the hardness of the flexible tip 225 may be in the range of about 60-80 on a Shore A scale. A hardness in the range of 60-80 on the Shore A scale allows the flexible tip 225 to deform enough to maintain proper contact with the OPC drum.

Figure 4:
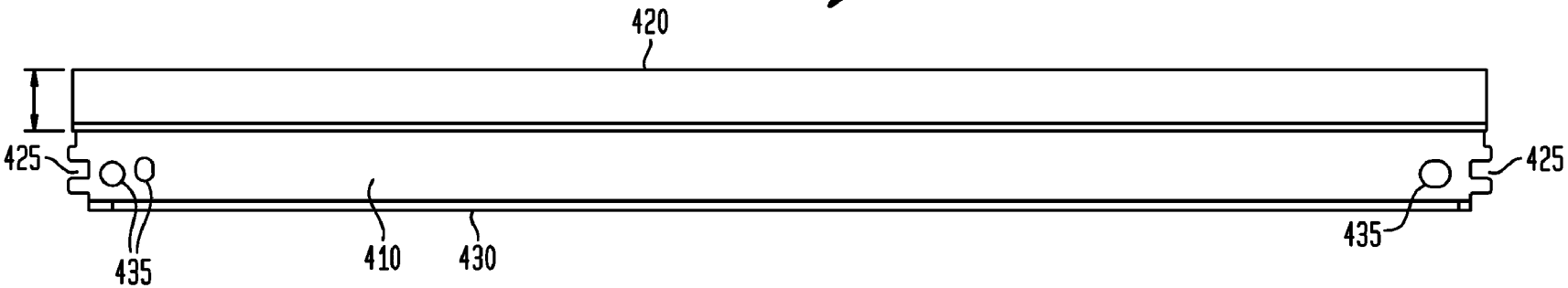
FIG. 4 shows a top view of a wiper blade in accordance with one embodiment of the present invention.

FIG. 4 displays a replacement wiper blade 400 in accordance with one embodiment of the present invention. The replacement wiper blade 400 has a main body 410, a back edge 430 and a flexible tip 420. The flexible tip 420 may be manufactured from polyurethane or other type of flexible material. The flexible tip 420 should be flexible enough to deform slightly when pressed against the OPC drum 205, but yet rigid enough to apply a sufficient amount of pressure to ensure a proper cleaning of the OPC drum 205. Also on the replacement wiper blade 400 are guides 425 and mounting holes 435. In one embodiment, the back edge 430 and the main body 410 may be manufactured by bending a single piece of metal such as aluminum, steel or the like. The guides 425 are positioned to line up with a guide protrusion (not shown) located on the waste bin assembly 120. The guide protrusion on the waste bin assembly 120 keeps the replacement wiper blade 400 from moving laterally when coupled against the OPC drum 205. After the replacement wiper blade 400 is attached on the waste bin assembly 100, it is held in place by mounting screws (not shown for ease of illustration) which may be inserted through the mounting holes 435 and fasten into the housing of the waste bin assembly 120.

When the replacement wiper blade 400 is installed against the OPC drum 205, the abutment pressure applied by the flexible tip 420 may be greater than that of the OEM wiper blade 220. In one embodiment, the abutment pressure may be increased by increasing the inroad amount $\epsilon$ pressed against the OPC drum 205. In one exemplary embodiment, this may be accomplished by altering the orientation of the guides 425 and the mounting holes 435 with respect to the OEM wiper blade 220. The guides 425 and the mounting holes may be moved about 0.020" (0.6 mm) towards the back 430. By moving the mounting holes 435 and the guides 425 backwards, the flexible tip will protrude forward about the same distance the mounting holes 435 and guides 425 are moved (in this case about 0.020" (0.6 mm)).

Figure 5:
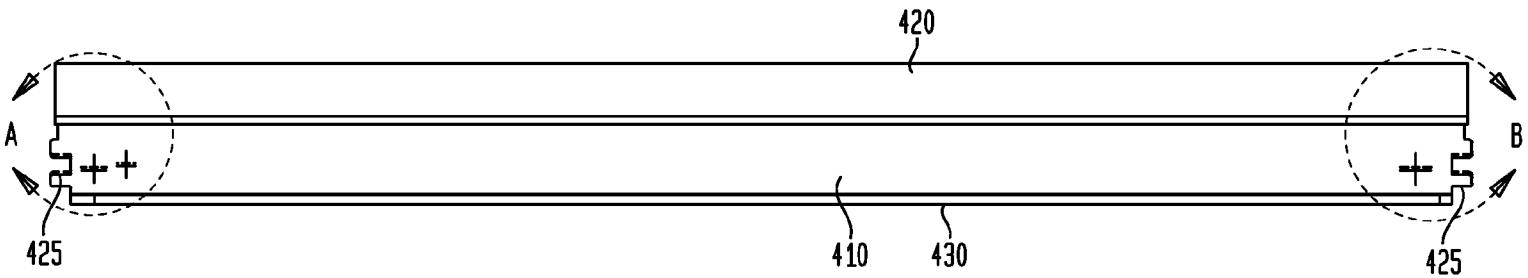
FIG. 5 shows a comparison top view of the wiper blade of FIG. 4 showing the projected position of a prior art wiper blade.
Figure 5B:
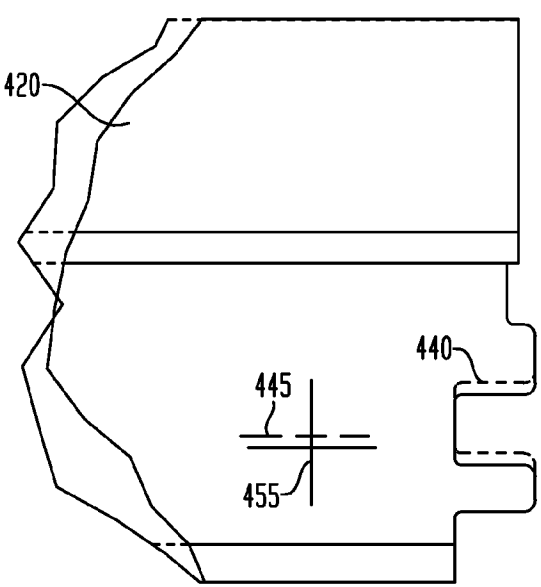
FIG. 5B shows a detailed view of the right side of the wiper blade of FIG. 5.
Figure 5A:
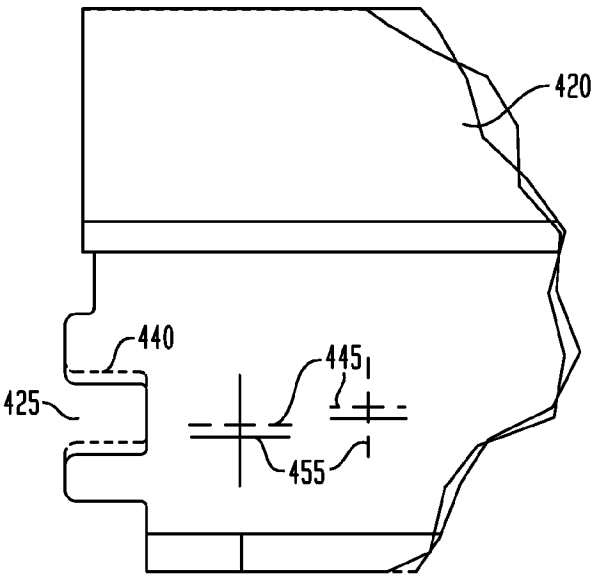
FIG. 5A shows a detailed view of the left side of the wiper blade of FIG. 5.

FIGS. 5, 5A and 5B display the replacement wiper blade 400 with respect to the orientation of the OEM wiper blade 220. As is displayed in FIGS. 5, 5A and 5B, the position of the guide of the OEM wiper blade 220 is displayed by dashed line 440. The centers of the mounting holes 435 of the replacement wiper blade 400 are shown by the solid lines 455. The mounting holes of the OEM wiper blade 220, shown by the dashed lines 445, are positioned farther towards the flexible tip 420 when compared to the mounting holes 435 of the replacement wiper blade 400. As was described previously, the predetermined distance in one embodiment may be about 0.020" (0.6 mm).

When the flexible tip 420 of the replacement wiper blade 400 is moved forward by about 0.020" (0.6 mm), the resulting inroad amount $\epsilon$ of the flexible tip 420 is about 0.0497" (1.3 mm). In this embodiment, the movement of the mounting holes 435 and the guides 425 by about 0.020" (0.6 mm) does not result in the inroads amount $\epsilon$ increasing by the same amount, roughly about 0.020" (0.6 mm). The inroads amount $\epsilon$ will be less than the amount the replacement wiper blade 400 is positioned forward due to the deformation of the flexible tip 420. In addition, because the tangential point where the edge of the flexible tip 420 has moved farther forward, the resulting preset angle $\Phi$ changes to about 24°.

In an alternate embodiment, the OEM wiper blade 220 may be modified in order to position the flexible tip 225 farther into the OPC drum 205. One way of modifying the OEM wiper blade 220 is to remove the flexible tip 225 and replace it with a flexible tip that is about 0.020" (0.6 mm) longer that the replaced flexible tip. The resulting inroad amount $\epsilon$ of the replacement flexible tip would be about 0.0497" (1.3 mm), and the resulting preset angle $\Phi$ would be about 24°

In yet another embodiment, the OEM wiper blade 220 may be modified by altering the guides and mounting holes. As those skilled in the art appreciate, a Dremmel®, a drill, or any type of modification tool may be used to modify the OEM wiper blade 220. In this embodiment, the center of the mounting holes and guides may be positioned in the locations of the guides 425 and mounting holes 435 of the replacement wiper blade as shown in FIG. 4.

Figure 6:
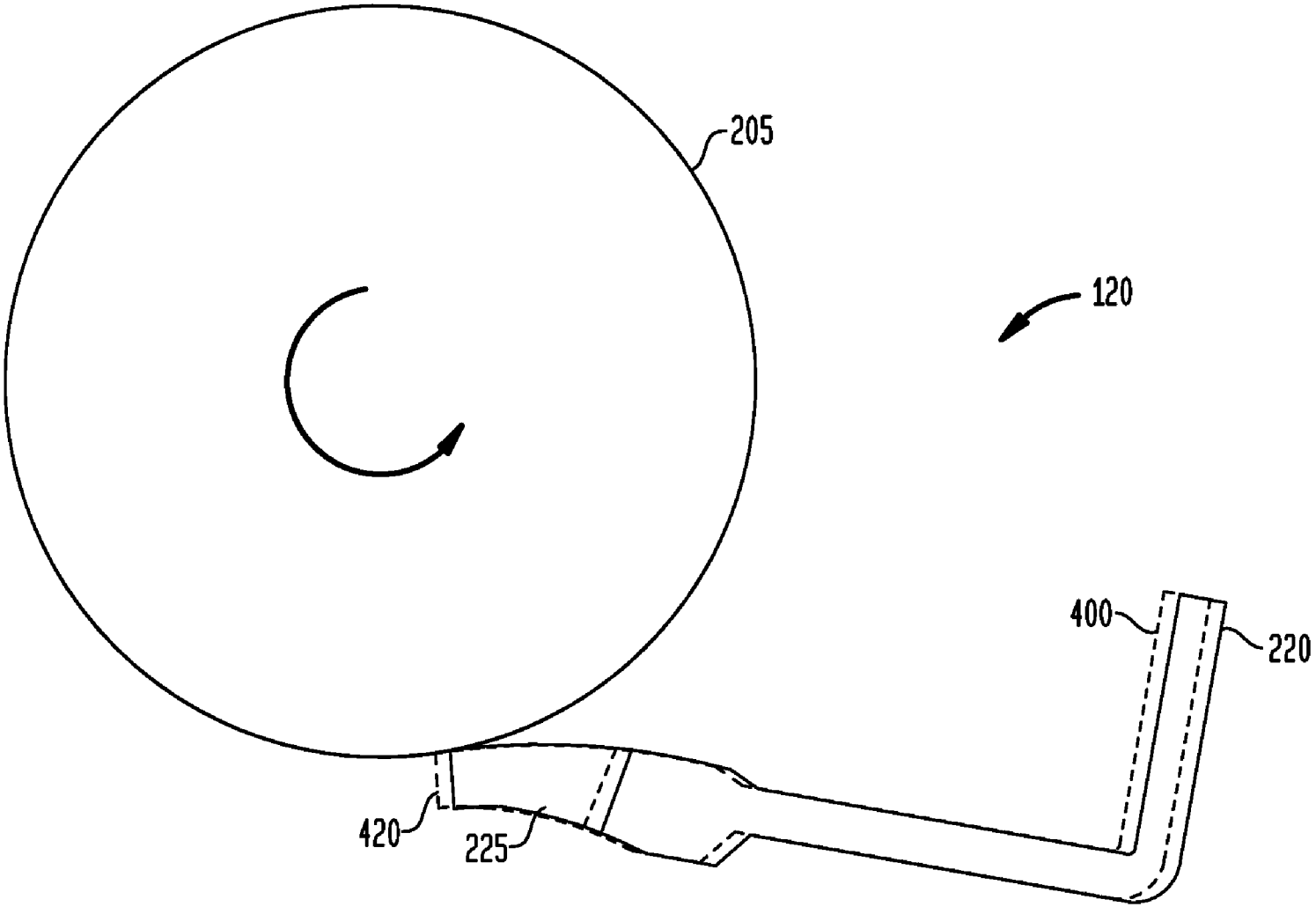
FIG. 6 shows a comparison side view of the wiper blade of FIG. 4 and a prior art wiper blade when installed in the waste bin assembly of FIG. 2.

FIG. 6 displays a side view of the waste bin assembly 120, and more specifically the OEM wiper blade 220 and the replacement wiper blade 400 (displayed in the dashed lines) installed against the OPC drum 205. As can be seen in FIG. 6, the replacement wiper blade 400 is positioned farther forward of the OEM wiper blade 220. When the replacement wiper blade 400 is attached to the waste bin assembly 120, the compression foam 240 (FIG. 2) may be designed to be able to expand the about 0.020" (0.6 mm) that the replacement wiper blade 400 moves forward. Alternatively, a replacement compression foam (not shown) may be developed if the compression foam 240 does not expand with sufficient strength to keep the waste collection area 215 sealed.

Although specific embodiments have been illustrated and described herein, those of ordinary skill in the art appreciate that any arrangement, which is calculated to achieve the same purpose, may be substituted for the specific embodiments shown and that the invention has other applications in other environments. This application is intended to cover any adaptations or variations of the present invention. The following claims are in no way intended to limit the scope of the invention to the specific embodiments described herein.

What is claimed is:

1. A method of modifying an imaging process cartridge comprising:

providing the imaging process cartridge, the imaging process cartridge having a waste bin assembly, the waste bin assembly further having an organic photo conductor (OPC) drum which is coupled with a first wiper blade, the first wiper blade exerting a first abutment pressure when the first wiper blade is coupled to the OPC drum, removing the first wiper blade, installing a second wiper blade, wherein the second wiper blade exerts a second abutment pressure when coupled to the OPC drum, wherein the first wiper blade forms a first preset angle when positioned against the OPC drum and the second wiper blade forms a second preset angle when positioned against the OPC drum, and the second preset angle is greater than the first preset angle.

2. A method of modifying an imaging process cartridge comprising:

providing the imaging process cartridge, the imaging process cartridge having a waste bin assembly, the waste bin assembly further having an organic photo conductor (OPC) drum which is coupled with a wiper blade, the wiper blade exerting a first abutment pressure when the wiper blade is coupled to the OPC drum, removing the wiper blade, modifying the wiper blade, reattaching the modified wiper blade, wherein the modified wiper blade exerts a second abutment pressure when coupled to the OPC drum, wherein the step of modifying the wiper blade further comprises modifying guides and mounting holes on the wiper blade.

3. A modified imaging process cartridge comprising:

a waste bin assembly, the waste bin assembly further having a replacement wiper blade coupled to an organic photo conductor (OPC) drum, the replacement wiper blade exerting a first abutment pressure against the OPC drum when the replacement wiper blade is in contact with the OPC drum, wherein the first abutment pressure is greater than an original abutment pressure caused by an original wiper blade when the original wiper blade was coupled to the OPC drum, wherein original wiper blade is modified in order to create the first abutment pressure, wherein the original wiper blade is modified by altering guides and mounting holes on the wiper blade.

* * * * *